US005087555A

United States Patent [19]

Saitou

[11] Patent Number: 5,087,555

[45] Date of Patent: Feb. 11, 1992

[54] SILVER HALIDE PHOTOGRAPHIC EMULSION AND METHOD FOR MANUFACTURE THEREOF

[75] Inventor: Mitsuo Saitou, Kanagawa, Japan

[73] Assignee: Fuji Photo Film Co., Ltd., Kanagawa, Japan

[21] Appl. No.: 501,825

[22] Filed: Mar. 30, 1990

Related U.S. Application Data

[62] Division of Ser. No. 336,406, Apr. 11, 1989, Pat. No. 4,945,037.

[30] Foreign Application Priority Data

Apr. 11, 1988 [JP] Japan ..... 63-088376

[51] Int. Cl.[5] ..... G03C 1/02

[52] U.S. Cl. ..... 430/567; 430/569

[58] Field of Search ..... 430/567, 569

[56] References Cited

U.S. PATENT DOCUMENTS

| | | | |
|---|---|---|---|
| 4,665,012 | 5/1987 | Sugimoto et al. | 430/567 |
| 4,701,405 | 10/1987 | Takiguchi et al. | 430/567 |
| 4,713,318 | 12/1987 | Sugimoto et al. | 430/567 |
| 4,766,058 | 8/1988 | Sampei et al. | 430/567 |
| 4,835,095 | 5/1989 | Ohashi et al. | 430/569 |

OTHER PUBLICATIONS

Twinning, The Solid State for Engineers, Maurice J. Sinnott, Sc. D., pp. 226–229, John Wiley & Sons, Inc., 1958.

*Primary Examiner*—Hoa Van Le

*Attorney, Agent, or Firm*—Sughrue, Mion, Zinn, Macpeak & Seas

[57] ABSTRACT

A silver halide photographic emulsion comprising silver halide grains is disclosed, wherein at least 60% of the total projected area of the silver halide grains is comprised of tabular silver halide grains having a central portion and an outer portion, of which the iodide content of the central portion is from 7 mol % to the solid solution limit, and which have two parallel twinned crystal planes.

A method for the manufacture of the silver halide emulsion is also disclosed, which comprises the steps of nucleating the silver halide grains under conditions where the gelatin concentration in the reaction solution is set at from 0.1 to 20 wt %, the addition rates of the silver salt and the halide are set at from $6\times10^{-4}$ to $2.9\times10^{-1}$ mol/minute per liter of reaction solution, and the pBr value in the reaction solution is set at from 1.0 to 2.5, Ostwald ripening the nucleated grains, and then growing the thus ripened grains.

5 Claims, 1 Drawing Sheet

SILVER HALIDE PHOTOGRAPHIC EMULSION AND METHOD FOR MANUFACTURE THEREOF

This is a divisional of application Ser. No. 07/336,406 filed Apr. 11, 1989, now U.S. Pat. No. 4,945,037.

FIELD OF THE INVENTION

This invention concerns silver halide emulsions and, more precisely, it concerns emulsions which contain silver halide grains which have a novel structure, and a method for the manufacture of these emulsions.

BACKGROUND OF THE INVENTION

Tabular silver halide grains which contain parallel twinned crystal planes (referred to below as tabular grains) have the advantages indicated below in terms of photographic characteristics, and it is for this reason that they have been used in commercial high speed photosensitive materials in the past.

1) They have a large specific surface area so that a large amount of sensitizing dye can be adsorbed on the surface and they have a high minus-blue/blue speed.

2) The grains are arranged parallel to the base surface when emulsions which contain tabular grains are coated and dried so that it is possible to reduce the thickness of the coated layer, thereby increasing sharpness.

3) When, with X-ray films, a sensitizing dye is added to the tabular grains, the extinction coefficient of the dye is greater than the extinction coefficient for the indirect transition of the silver halide and it is possible to achieve a marked reduction in cross-over light in this way, thereby preventing any worsening of picture quality.

4) A high covering power can be realized when developing tabular grains which have a high aspect ratio, the silver density and dye density are evened out, and there is an improvement in terms of the RMS granularity characteristics.

5) The absorption of radiation increases exponentially with respect to the thickness of the grain, but with tabular grains the grains are thin and so the amount of radiation absorbed per grain is low and there is little fogging due to natural radiation with the passage of time.

6) There is little light scattering and it is possible to obtain images which have a high resolution.

7) The grains have flat, parallel surfaces giving rise to an optical interference effect with respect to the parallel plates and it is possible to increase the light utilization efficiency by making use of this effect.

8) The rate of development is proportional to the specific surface area of a silver halide grain, and tabular grains have a large specific area and, therefore, a high development rate.

Tabular grains have been widely used in high speed sensitive materials in the past because of their many advantages, such as those indicated above.

The term "aspect ratio" as used herein signifies the ratio of the diameter to the thickness of the tabular grain. Moreover, the diameter of the tabular grain signifies the diameter of a circle which has the same area as the projected area of the basal plane of the grain when the emulsion is observed using a microscope or an electron microscope.

On the other hand, it is known that the various photographic effects indicated below can be realized by including iodide ions in the silver halide.

Thus, in connection with the photosensitive process:

(1) In the photosensitive process, the absorbing band wavelength is extended on the long wavelength side in the intrinsic absorption region, the extinction coefficient is increased, and the blue absorption efficiency is raised.

(2) The refractive index is increased and so a larger optical interference effect in the tabular grains can be anticipated, as described in *Research Disclosure,* 25330 (May, 1985).

(3) In the band structure, the valency electron band is raised in the Photoholes which are generated by the absorption of light accumulate in the parts which have a high iodide content. Thus the separation of electrons and photoholes is promoted.

Reference can be made to the disclosures made in JP-A-60-143331 and JP-A-60-143332, *Journal of Imaging Science,* 29, 193 (1985) and JP-A-63-92942 in connection with this effect in the case of grains which have a double structure. (The term "JP-A" as used herein means an "unexamined published Japanese patent application".)

(4) When sensitizing dyes are adsorbed on silver halide layers which have a high iodide content and the grains are given a minus blue exposure, the iodide has the effect of increasing the photohole implanation efficiency from the sensitizing dye to the silver halide grains, and reactions occur with reduced silver nuclei within the grains with the release of electrons.

Reference can be made to the disclosures of Japanese Patent Application No. 62-251377 in connection with this effect.

(5) The iodide ions themselves have a photohole trapping effect.

(6) Lattice irregularity defects and dislocations occur between layers which have very different iodide contents and photographic effects arise on the bases of these defects and dislocations. Reference can be made to the disclosures made by J.W. Mitchell in *Nippon Shasshin Gakkaishi (Journal of Japan Photographic Academy),* volume 48, 191 (1985), and JP-A-63-220238.

On the other hand, in connection with the development process:

(7) The spread of the silver filaments after development is small and graininess is good. Furthermore, in the case of color development the spread of the dye cloud which is formed surrounding the grains is suppressed to a low level and this has the effect of improving graininess.

(8) The edge effect, due to the development inhibiting action of the iodide ion which is released in the transverse direction during development, is increased and this has the effect of improving resolution.

Furthermore, the iodide ion which is released in the longitudinal direction during development has an interlayer development inhibiting effect which inhibits the development of adjacent layers.

(9) In cases where graininess is improved by stopping development without developing the whole of each grain and suppressing the spread of the filamental silver or dye cloud to a low level, or in cases where, in the course of a parallel development process such as color negative development, there is a DIR effect which is effective in the later stages of the development process, the later stages of development are suitably slowed down and the control can be achieved easily.

(10) There is an effect on the contrast enhancing development with glutaraldehyde which is often used with X-ray film systems.

Furthermore, the introduction of iodide ion has an effect on pressure characteristics by hardening the silver halide grains, as disclosed by P.V.McD. Clark and J.W. Mitchell, *J. Phot. Sci.*, Volume 4, 1 (1956).

(11) The iodide promotes the adsorption of sensitizing dyes and additives on the silver halide grain surface.

Hence, the development of grains in which the effects of the aforementioned tabular grains and the effects of iodide ion as indicated above are combined is desirable.

In general, tabular grains have two or more parallel twinned crystal planes. It is necessary to have at least two parallel twinned crystal planes to form a tabular grain, but in grains which have three or more twinned crystal planes the speed of the inner part is increased and this is undesirable. This is because twinned crystal planes are a type of crystal defect and the speed of the inner part is increased by a synergistic effect when numerous twinned crystal planes are present. Hence, grains which have only two twinned crystal planes are the most desirable.

The shape of the main surface of a tabular grain which has only two parallel twinned crystal planes is hexagonal with an adjacent side ratio (length of the longest side)/(length of the shortest side) of from 2 to 1. In cases where the tabular grains are arranged on a flat surface with the closest packing with the basal planes parallel, configurationally, the shape of the basal planes which provides the best resolution and more or less equal resolution in all directions is the a hexagonal shape and hence this is the ideal sensor arrangement.

Reference can be made to the descriptions given in chapter 1 of *Image Science*, by J.C. Dainty and R. Shaw, published by the Academic Press Inc., London, 1974, in this connection.

From this point of view also, hexagonal tabular grains are the most desirable.

According to J.E. Maskasky, *J. Imaging Sci.*, volume 31, 15-26 (1987), triangular tabular grains are grains which have three parallel twinned crystal planes. In this case, when comparing hexagonal tabular grains with triangular tabular grains which have the same projected area, the maximum diameter of a triangular grain is 1.23 times larger than the maximum diameter of a hexagonal grain, and so graininess is worse in the case of triangular tabular grains. Hence, triangular tabular grains are undesirable.

Furthermore, when dopants such as metal ions and changes in halogen composition are introduced to control the grains in an intended location, with a hexagonal tabular grain it is possible to introduce the dopant or change for control at the intended location since the six sides have more or less the same growth rate, and it possible in this way to obtain the intended photographic characteristics. Hence, hexagonal tabular grains are also preferred from this point of view.

Furthermore, an even size distribution of tabular grains is preferred. Thus, disadvantages such as those indicated below arise in cases where the size distribution is not mono-disperse.

1) High contrast (which is to say high gamma) characteristic curves cannot be anticipated.

2) A multi-layer system obtained by coating a mono-disperse large sized grain layer as an upper layer and a mono-disperse small sized grain layer as a lower layer provides a higher speed in terms of the utilization efficiency of the light than a coated emulsion layer in which large and small sized grains are mixed together, and the multi-layer effect cannot be utilized satisfactorily.

Here, a case which does not have good mono-dispersivity signifies (1) the admixture of rod like grains, tetrapod like grains, and grains which have a single twinned crystal plane or non-parallel twinned crystal planes with the tabular grains, (2) the admixture of triangular tabular grains, trapezoidal tabular grains and rhomboidal tabular grains other than hexagonal tabular grains with the tabular grains, and (3) tabular grain which have a wide projected grain size distribution.

On the basis of the facts outlined above, tabular grains which have a high iodide content, and which have only two parallel twinned crystal planes (and of which the shape of the basal plane is therefore hexagonal), and a large specific surface area, and which have a good mono-dispersivity are clearly desirable.

However, the main problem when iodide ions are introduced is that, as disclosed in JP-A-58-113928, a great many thick, non-tabular, grains are admixed with the tabular grains when a high iodide ion content is introduced into the central portions of tabular grains.

For example, the methods for the preparation of tabular grains containing a central portion of a high iodide content described, for example, by C.R. Berry and S.J. Marino, in *Journal of Physical Chemistry*, 62, 881 (1958), A.P.H. Trivelli and W.F. Smith, *The Photographic Journal*, 80, 285 (1940), E.B. Gutoff, *Photographic Science and Engineering, 14, 248-257* (1970) and Cugnac and Chateau, *Science et Industrie Photographique*, 33, 121 (1962) all provide a high proportion of thick, non-tabular, grains and a wide grain size distribution, and they cannot be said to provide the distinguishing features of the tabular grains described above.

There is also a second problem in that with the conventional methods of grain formation (especially the methods in which iodide ion is added to the reactor before the introduction of the silver salt and the halide, and the methods in which silver iodide is used as seed crystals, as disclosed in U.S. Pat. Nos. 4,150,944, 4,184,877 and 4,184,878), it is impossible to provide a prescribed composition of fixed iodide content in the central portion of the tabular grain or to form a silver bromoiodide layer of uniform composition. Furthermore, with the methods in which silver iodide is used for the seed crystals, the proportion of hexagonal tabular grains among the tabular grains which are formed is low, and the proportion of deformed tabular grains, such as trapezoidal and rhomboidal tabular grains, is high.

Conditions of growth for providing tabular grains with a more mono-disperse grain size distribution have been suggested by the present inventors in JP-A-55-142329.

In this case, the coefficient of variation at an average grain diameter of 0.96 μm was 11.6%, and the grain size distribution was very uniform for an emulsion consisting of multi-twinned crystal grains (grains which had a double structure with a silver bromoiodide layer which had a high iodine content for the core part), but the proportion of non-parallel twinned crystal grains was high because inappropriate nuclei forming conditions were used when forming the seed crystals.

Furthermore, the double structure, twinned crystal grains described in the illustrative examples of JP-A-60-143331 were prepared using a rush addition single jet method for nuclei formation and so the grains obtained had a low proportion of hexagonal tabular grains.

Various investigations have been carried out in connection with these problems.

For example, in connection with the first problem, as suggested in JP-A-58-113928, tabular core grains can be formed in the region where the proportion of formed non-tabular grains is low by having the state in the reactor before the introduction of the silver salt and the bromide salt essentially iodide ion free (iodide ion concentration less than 0.5 mol%), adjusting the pBr value to within the range of from 0.6 to 1.6, and by using essentially silver bromide (the iodide ion content of silver bromoiodide being preferably less than 5 mol% and most desirably less than 3 mol%), after which a high iodide content layer (as an intermediate with an iodide content preferably of almost the solid solution limit, more preferably of from about 6 to 20 mol%) can be deposited over the core grains, and then a layer of silver bromoiodide which has a low iodide content can be deposited over the top of this as a shell to form silver halide grains which have a triple structure.

However, in this case, only tabular grains which have a low iodide content in the central portion are obtained. Further, the intentional preparation of the parallel double twinned crystal grains has not been approached in this case.

The central portion also has a low iodide content when silver iodobromide tabular grains are formed using the methods disclosed in JP-A-59-99433, JP-A-61-14630 and JP-A-58-211143.

A method for the formation of tabular grains with a low proportion of non-tabular twinned crystal grains by limiting the iodide ion concentration in the reactor prior to the introduction of the silver salt and bromide in accordance with the values indicated below has been proposed in JP-A-62-151840, $$\frac{1.50}{p\mathrm{Br}} + 1.20 < pI < \frac{2.60}{p\mathrm{Br}} + 1.33$$

However, since the halide being added is the substantially bromide, the average iodide content of the nuclei grains in the illustrative examples is from 5 to 6 mol% or less in the silver bromoiodide, and the central portion still has a low iodide content. Further in this case, since most of the iodide ion used in the nuclei formation are previously present in the reactor, the silver iodide nuclei are first formed.

Furthermore, the mono-disperse twinned crystal grains in JP-A-51-39027 and JP-A-61-112142 are prepared by adding a silver halide solvent after nuclei formation, ripening the emulsion, and then growing the grains, but in both cases the grains are tabular grains of which the central portion has a low iodide content.

Furthermore, JP-A-63-151618 and Japanese Patent Application No. 62-319740 by the present inventors disclose monodisperse parallel double twinned crystal tabular grains. However, the grains used in their illustrative examples are tabular grains of which the central portion has a low iodide content (7 mol% or less).

However, tabular grains which have a low iodide content silver bromide in the central portion and a layer which has a high iodide content on the outside have the following disadvantages:

a) A large difference in iodide content arises between the low iodide content layer of the central portion and the high iodide content layer on the outside of this, large disturbances are created in the periodic lattice of the crystal with the formation of electron trapping centers, and the photographic speed is reduced.

b) With triple structure silver halide grains as disclosed in JP-A-58-113928, only the intermediate layer has a high iodide content and so the volume fraction of the high iodide content layer with respect to the whole grain is not large. In the case of tabular grains, it is not possible to form seed crystals consisting of 100% tabular grains with nuclei formation alone and so nuclei formation→Ostwald ripening is used, and this results in the size of the seed crystals becoming, in terms of the average grain diameter, from 0.4 to 0.6 μm.

c) Development inhibition in the later stages of a parallel development process is normally effective for improving graininess, but it is difficult to achieve this effect with grains which have a low iodide content in the central portion.

Hence, the production of tabular grains which have a high iodide content in the central portion, which have two parallel twinned crystal planes per grain, which have the characteristics of tabular grains (a large specific surface area), and which have good mono-dispersivity is desirable.

SUMMARY OF THE INVENTION

The aims of this present invention are to provide silver halide photographic emulsions which have a high speed, and which provide images which have excellent graininess, sharpness and resolution, and a high covering power, and a method for the preparation of such emulsions.

These aims have been realized by means of the invention as indicated below.

Thus, the invention provides a silver halide photographic emulsion comprising silver halide grains, wherein at least 60% of the total projected area of the silver halide grains is comprised of tabular silver halide grains having a central portion and an outer portion, of which the iodide content of the central portion is from 7 mol% to the solid solution limit, and which have two parallel twinned crystal planes.

The invention also provides a method for the manufacture of a silver halide emulsion comprising silver halide grains, at least 60% of the total projected area of the silver halide grains being comprised of tabular silver halide grains having a central portion and an outer portion, of which the iodide content of the central portion is from 7 mol% to the solid solution limit, and which have two parallel twinned crystal planes, which comprises the steps of nucleating the silver halide grains under conditions where the gelatin concentration in the reaction solution is set at from 0.1 to 20 wt%, the addition rates of the silver salt and the halide are set at from $6 \times 10^{-4}$ to $2.9 \times 10^{-1}$ mol/minute per liter of reaction solution, and the pBr value in the reaction solution is set at from 1.0 to 2.5, Ostwald ripening the nucleated grains, and then growing the thus ripened grains.

BRIEF DESCRIPTION OF THE DRAWINGS

FIGS. 1 to 3 represent examples of an outermost layer low iodide content type tabular grain.

FIGS. 4 to 6 represent examples of an outermost layer high iodide content type tabular grain.

FIGS. 7 to 9 represent examples of these combinations.

In these figures, a black part shows a central portion high iodide content layer, a white part shows an outer portion low iodide content layer and a shaded part shows an outer portion high iodide content layer.

Figure 9:
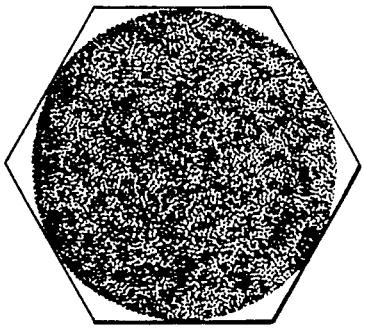

Further, FIGS. 1 to 8 each shows a cross sectional view through a center line of the tabular grain, and FIG. 9 shows a top view of the tabular grain.

DETAILED DESCRIPTION OF THE INVENTION

The silver halide photographic emulsions of this invention are such that tabular silver halide grains which have an iodide content in the central portion of from 7 mol% to the solid solution limit, and which have two parallel twinned crystal planes, account for at least 60% of the total projected area of the silver halide grains.

The terminology "central portion" means the portion of stable nuclei formed in the nucleation stage hereinafter described, i.e., the region excluding the portion deposited during the crystal growth stage hereinafter described.

Here, the solid solution limit means the maximum mol% of iodide which can be present in solid solution in the silver halide, and this depends on the temperature at which the crystals are formed and the formation conditions. For example, with silver bromoiodide crystals precipitated in the presence of gelatin with excess alkali halide, the solid solution limit $I_{max}$ is given by the following equation, where t = temperature:

$$I_{max}(mol.\%)=34.5+0.165(t-25)$$

Thus, for example, the value is about 40 mol% at 60° C. Reference can be made to T.H. James, *The Theory of the Photographic Process,* 4th Ed., Chapter I, published by Macmillan, New York, 1977 for further details.

The actual tabular grains which have two parallel twinned crystal planes of this invention have two forms as described below.

(1) Hexagonal tabular grains in which the shape of the based plane of the tabular grain is hexagonal with a ratio of adjacent sides not greater than 2, and of which the linear part ratio of the hexagons is at least 4/5, and of which, moreover, the aspect ratio has a value of at least 2.

(2) Circular tabular grains in which the shape of the based plane of the tabular grain is circular, with a linear part ratio of the based plane of from 4/5 to zero, and of which the aspect ratio is at least 2.0.

Here, the ratio of adjacent sides is the ratio of the lengths of longest side/shortest side of the sides which form the hexagon in a single hexagonal tabular grain. Furthermore, in cases where the corners are partially or fully rounded off, the length of a side is taken as the distance between the points of intersection on extending the linear part of this side and extending the linear parts of the adjacent sides. The linear part ratio in this invention is the ratio (length of the linear part of the hexagon)/(distance between the points of intersection of the extended lines). More detailed explanation of the linear part ratio can be referred to the disclosures in Japanese Patent Application No. 62-203635 and U.S. patent application Ser. No. 07/233,110.

A distinguishing feature of the tabular grains of this invention is that they have two parallel twinned crystal planes, and this can .be confirmed by observing ultrathin (about 0.1 μm or less) slices of the cross section of an emulsion coated film at low temperature (liquid nitrogen or liquid helium temperatures) using a transmission type electron microscope.

The number of parallel twinned crystal planes is limited in the tabular grains of this invention because the presence of three or more such planes increases the internal speed of the grains as a result of the synergistic effect of the defects.

The tabular grains of this invention are preferably mono-disperse. Here, the mono-dispersivity is represented by the coefficient of variation [the value obtained by dividing the range (standard deviation) of the grain size represented by the diameter of the circle corresponding to the projected area of the basal planes of the tabular grains by the average grain size], and mono-disperse tabular grains of this invention are grains of which the coefficient of variation has a value of not more than 40%, preferably of not more than 35%, and more preferably of not more than 20%.

The average aspect ratio of the tabular grains of this invention is at least 2, preferably from 2 to 40, and most desirably from 4 to 16. Here, the average aspect ratio means the average value of the aspect ratios of all the tabular grains having a gain diameter of 0.2 μm or more which are present in the emulsion. The range for the aspect ratio has been set at 40 or less because tabular grains which have an aspect ratio in excess of 40 are liable to break on agitation during the preparation of an emulsion or when, in the coated and dried state, the film is subjected to pressure or physical shock, and because the latent image becomes diffused within the grain.

The average grain size, i.e., diameter, of the tabular grains of the present invention is at least 0.2 μm and preferably from 0.2 to 5 μm, and the average thickness is at least 0.03 μm, and preferably from 0.04 to 0.7 μm. This is because graininess is adversely affected when the grain size exceeds 5 μm in diameter, and because the distinguishing features of the grains are minimized when the thickness exceeds 0.7 μm.

The silver halide emulsions of the present invention are such that tabular silver halide grains which have a central portion iodide content of from 7 mol% to the solid solution limit and which have two parallel twinned crystal planes account for at least 60%, preferably at least 70%, and most desirably at least 90%, of the total projected area of the silver halide grains. This value is set to at least 60% since the presence of less than 60% of such grains does not enable the excellent photographic properties which can be obtained with tabular grains of the present invention to be realized.

The iodide content of the central portion of the tabular grains of this invention is from 7 mol% to the solid solution limit, and preferably from 10 to 35 mol%, and the preferred halogen composition of the central portion is such as to provide a silver bromoiodide or a silver bromoiodochloride in which the chlorine content is not more than 10 mol%. The silver iodide content of the central portion is set to from 7 mol% to the solid solution limit since in the presence of less than 7 mol% it is not possible to realize the excellent photographic characteristics of silver halide tabular grains which have a high iodide content in the central portion, while exceeding the solid solution limit results in the formation on separate silver iodide grains, and this is undesirable.

Furthermore, the chlorine content is set to not more than 10 mol% since a chlorine content above 10 mol% leads to a loss of the excellent photographic properties of the tabular silver halide grains which have a high iodide content in the central portion in respect of the light absorption efficiency and the restrained development properties.

The halogen composition of the portion outside the central portion (i.e., an outer portion) may be silver iodobromide, silver bromide, silver chloroiodobromide, silver chlorobromide or silver chloride. The silver halide grains of the present invention can be classified into two types as indicated below according to the halogen composition of the part outside the central portion.

(I) Those in which the iodide ion content of the outermost shell is not more than 6 mol%.

Figure 1:
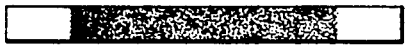
FIGS. 1 to 9 illustrate the preferred embodiments of the tabular grains of the present invention.
Figure 2:
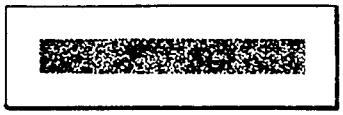
Figure 3:
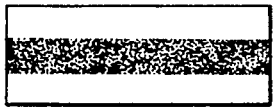
Figure 4:
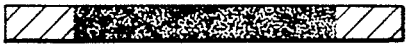
Figure 5:
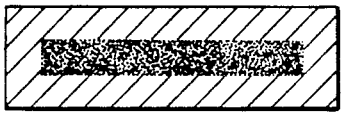

In this case the distinguishing features are as follows:

(a) As shown in FIG. 1 of JP-A-63-92942, the valency electron band of the outermost layer silver halide is located lower with respect to the vacant level than that of the central portion, and so in the case of a blue exposure the photoholes migrate into the inside of the grain and the electrons migrate to the surface of the grain, separation of the electrons and photoholes is promoted, and latent image formation occurs more efficiently.

(b) The development activity of the silver halide grain surface is increased and the initial rate of development is speeded up.

In such a case, the effects of (a) and (b) described above become more pronounced as the chlorine content of the shell part is increased. The halogen composition of the shell is silver iodobromide or silver chloroiodobromide which has an iodide content of not more than 6 mol%, but no limitation is imposed on the bromine and chlorine content. However, the chlorine content is preferably not more than 40 mol%, and most desirably not more than 30 mol%, for forming tabular grains which have a high aspect ratio.

(II) Those in which the iodide ion content of the outermost shell layer of the outer portion is from 6 mol% to the solid solution limit, and preferably from 6 to 30 mol%.

In this case the distinguishing features of the grains are as follows:

(a) The absorption efficiency of blue light is good because the outermost layer of the shell part also has a high iodide content, and this contributes to an increase in speed.

(b) Photohole implantation from the sensitizing dye is facilitated since the energy level of the upper end of the valency electron band of the outermost shell layer is raised, the implanted photoholes react with the reduction sensitized silver nuclei within the grain in accordance with the equation shown below and electrons are generated and this contributes to an increase in speed.

$$Ag_2 + \text{Photohole} \rightarrow Ag + Ag^+ \rightarrow 2\,Ag^+ + e$$

(c) The initial rate of development is retarded and graininess is improved.

(d) Adsorption of the sensitizing dye is facilitated when the surface has a high iodide content, more sensitizing dye can be adsorbed, and the light absorption efficiency is improved.

The thickness of the shell layer is preferably at least 0.01 μm, and more preferably from 0.01 to 0.2 μm. The distribution of the iodide ion content of the tabular grains is normally uniform, but there may be a nonuniform distribution.

No particular limitation is imposed on the average proportion by volume of the central portion with respect to the total volume of the tabular grain, but it is normally from 0.05 to 0.9.

The halogen composition of the tabular grain may be uniform, or the inner and outer parts may have a different halogen composition, and the grain may have a layer structure. The change in halogen composition between the layers may be of a gradual type or of an abrupt type, according to the intended purpose.

The preferred structure embodiments of the tabular grains according to the present invention are illustrated as FIGS. 1 to 9.

The introduction of reduction sensitized silver nuclei into the grains is desirable. Whether or rot reduction sensitized silver nuclei are present can be determined easily by exposing the emulsion, carrying out internal development in the usual way, drawing an H - D curve and checking for a reversal image in the internal fog which is present.

Reduced silver nuclei are required in silver iodobromide systems since even if the photoholes which are generated by the absorption of light are trapped in the high iodide layer of the central portion, they are trapped temporarily, and the conversion of the photohole to an electron is not carried out. The present inventors have verified this effect in silver iodobromide systems with grains which have a double structure consisting of a silver bromoiodide central portion with a silver bromide shell.

Furthermore, the hexagonal tabular grains of this invention do not require the use of silver iodide nucleus as a seed crystal, as described in JP-A-52-153428, and so there in no silver iodide nucleus within the grain.

The crystal habit of the tabular grains of this invention is normally a {111} plane, but they may also have {100} planes. In this case, the preferred range for the value of the ratio (surface area of the {100} plane on the side surface)/(overall surface area of the tabular grain) is from 0 to 0.5. The area proportions of the {111} plane and the {100} plane can be measured using the method based on the surface selective adsorption dependence of sensitizing dyes with respect to these planes.

Reference can be made to the disclosures of T. Tani, *Journal of Imaging Science.* 29, 165 (1985) and Japanese Patent Application No. 63-315741.

Furthermore, the number of chemically sensitized nuclei formed per grain is increased because tabular grains have a large surface area/volume ratio. As a result, latent image dispersion is liable to occur, and so limitation of the number of chemically sensitized nuclei per grain and/or of the locations at which the chemically sensitized nuclei are formed is desirable with the tabular grains of this invention. Reference can be made to the disclosures in J.E. Maskasky, *J. Imaging Sci.,* 32, 160 (1988), JP-A-64-38742 and made by the inventors in Japanese Patent Application Nos. 63-315741, 63-26979, 63-153722 and 63-223739 in connection with the details of these limitations and actual procedures.

Figure 7:
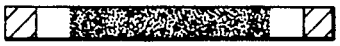
Figure 8:
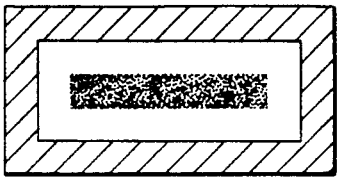

Furthermore, there is an embodiment in which chemically sensitized nuclei are preferentially formed on the crystal surface on which adsorbants are sparsely adsorbed by utilizing the difference in adsorbing effects of the adsorbants between the high iodide content layer surface and the low iodide content layer surface, as shown in FIGS. 1, 7 and 9. For example, the adsorption strength of cyanine dye of the high iodide content layer is higher than that of the low iodide content layer, and to the contrary, the adsorption strength of antifoggant of the high iodide content layer is lower than that of the low iodide content layer. Reference can also be made to the disclosures in the above-described publications.

Methods for the preparation of silver halide emulsions of this invention are described below.

The silver halide emulsions of this invention can be prepared using any of the procedures shown below:

Nuclei formation→Ostwald ripening (1)

Nuclei formation→Ostwald ripening→Growth (2)

Nuclei formation→Ostwald ripening→Growth→Second Ostwald ripening (3)

The basic processes of nuclei formation, Ostwald ripening, growth, and second Ostwald ripening are described below.

Referred conditions of each process are summarized in Table 1 below.

TABLE 1

| | Molecular Weight of Gelatin | Gelatin Concentration (wt %) | Silver Halide Solvent Concentration (M/liter) | pBr | Temperature (°C.) |
|---|---|---|---|---|---|
| Nuclei Formation | (a) 1,000–100,000<br>(b) 3,000–60,000 | (a) 0.1–20<br>(b) 0.3–6 | (a) 0–0.15 | (a) 1–2.5<br>(b) 1.4–2.4 | 15–60 |
| First Ostwald Ripening | | | | | |
| First low pBr ripening | 80,000–300,000 (Normally 100,000) | 1–10 | 0–0.15 | 1.4–2.3 | 40–85 |
| Second low pBr ripening | 80,000–300,000 (Normally 100,000) | 1–10 | 0–0.3 | pBr 2.1–pAg 2 | 40–85 |
| Crystal Growth (pBr 1.5–4.0) | | | | | |
| Low pBr | Normally 100,000 | 1–10 | 0–0.15 | 1.5–2.0 | 40–85 |
| High pBr | Normally 100,000 | 1–10 | 0–0.15 | 2.0–4.0 | 40–85 |
| Second Ostwald Ripening | Normally 100,000 | 1–10 | 0–0.15 | 2–4 | 40–85 |

(a): Preferred range
(b): More preferred range

Reference can also be made to the disclosures made by the inventors in Japanese Patent Application Nos. 63-315741, 62-203635, and 63-223739 and JP-A-63-11928, JP-A-63-151618 and JP-A-63-92942 in connection with the details of each of these processes.

1. Nuclei Formation

Nuclei formation is carried out by adding aqueous solutions of silver salt and halide at rates of from $6 \times 10^{-4}$ to $2.9 \times 10^{-1}$ mol/minute per liter of reaction solution to an aqueous solution containing from 0.1 to 20 wt% of gelatin as a dispersion medium, while maintaining a pBr value of from 1.0 to 2.5.

In this case, there is essentially no iodide present in the reactor prior to the introduction of the silver salt and the halide and the degree of supersaturation at this time is controlled within the region in which the value of the ratio A (projected area of tabular grains which have two parallel twinned crystal planes of this invention)/B (projected area of whole grains in the silver halide emulsion) is greater than 0.6.

As the grains other than those which have two parallel twinned crystal planes, there may be mentioned the grains which have no twinned crystal plane, those which have a single twinned crystal plane, those which have non-parallel twinned crystal planes and those which have three or more twinned crystal planes.

It was known in the past that the proportion of non-parallel twinned crystal planes formed increased when attempts were made to introduce a high iodide content layer into the central portion of tabular grains, and it has been discovered that this is because the degree of supersaturation during nuclei formation increases when the iodide content is increased. In the present invention, the introduction of a high iodide content layer into the central portion of the tabular grains having little formation of grains with non-parallel twinned crystal planes is made possible by controlling the other factors which affect the degree of supersaturation during nuclei formation.

The results obtained on investigating the nuclei forming conditions for this purpose are given below.

In the past it was concluded by C.R. Berry and D.C. Skillman, *Journal of Applied Physics*, 33, 1900 (1962) for example that, since twinned crystal planes were formed on increasing the bromide ion concentration of the solution during nuclei formation, the formation of twinned crystal planes was due to the precipitation of $AgBr_3^{2-}$, and J. Rodgers, *Symposium Paper on Growth of Photosensitive Crystals*, Cambridge, England, pp. 12–14 (September, 1978) stated that twinned crystal plane formation started to occur when the relative concentration of $AgBr_3^{2-}$ reached 50%.

That is to say, twinned crystal plane formation was thought to be related to the presence of $AgBr_3^{2-}$ ions.

However, in the present invention, it has been found that it is possible to reduce the probability of twinned crystal grain formation if the bromine ion concentration in the reaction solution is reduced, and that even at the same pBr value it is possible to control the probability of twinned crystal plane formation by using at least one of the means indicated below.

(1) The probability of twinned crystal plane formation is reduced when the gelatin concentration is increased.

(2) The probability of twinned crystal plane formation is reduced when the rate of agitation is increased and the state of agitation is improved.

(3) The probability of twinned crystal plane formation is reduced when the rates of addition of the aqueous solutions of silver salt and halides are reduced.

This effect is not due to a change in the gelatin concentration in the vicinity of the addition ports resulting from a change in the addition rate since a similar effect can be obtained by using the same gelatin concentration as that of the aqueous gelatin solution in the reactor in the aqueous solutions of silver nitrate and potassium bromide.

(4) The probability of twinned crystal plane formation is reduced as the temperature during nuclei formation is increased.

(5) The probability of twinned crystal plane formation is reduced when silver halide solvent such as ammonia and thioethers are added and the solubility is increased.

(6) The probability of twinned crystal plane formation is reduced when a gelatin made from the skins of fish which inhabit cold seas (gelatins which have low proline and hydroxyproline contents and in which interchain hydrogen bonds are formed, for example the "Hipure" gelatin made by the Norland Co. (Canada)) is used.

(7) The probability of twinned crystal plane formation falls in connection with (1) above when gelatin is added to either or both of the aqueous solutions of silver salt and halide which are being added so that there is no dilution effect on the gelatin concentration around the addition ports where these aqueous solutions are being added. (In this case, the gelatin which is added is preferably an alkali treated gelatin or a low molecular weight gelatin (molecular weight from 2,000 to 100,000).)

(8) The probability of twinned crystal plane formation is reduced as the pH of the reaction solution is reduced at low reaction solution temperatures below 35° C., but the dependence on temperature is slight at temperatures above 35° C.

(9) The probability of twinned crystal plane formation is reduced as the concentration of the unrelated salt (for example sodium nitrate or potassium nitrate) in the reaction solution is increased.

(10) The probability of twinned crystal plane formation is reduced as the molecular weight of the gelatin in the reaction solution is reduced from 100,000 to 20,000, and the extent of this reduction increases on reducing the molecular weight further below 20,000.

(11) The probability of twinned crystal plane formation is increased when the chloride ion concentration is increased at a fixed pBr value, and the frequency of twinned crystal plane formation decreases in the order $I^- > Br^- > Cl^-$ in the presence of the same excess concentration of iodide ion, bromide ion or chloride ion.

(12) The probability of twinned crystal plane formation increases as the extend of the oxidation treatment of the gelatin with hydrogen peroxide is increased.

These dependencies have been noted in FIG. 2 to 11 of JP-A-63-92942 and described in Japanese Patent Application No. 63-223739.

Thus, the frequency of tabular grain formation increases when all of these factors are shifted in the direction which increases the probability of twinned crystal plane formation, and as this increase takes place so the proportion of grains having non-parallel multiple twinned crystal planes formed increases.

With the conventional methods, the effect of the iodide ion is pronounced, the probability of tabular grain formation being increased by a factor of about eight times on increasing the iodide content from 0 to just 5 mol%, for example, but problems arise here because there is also a pronounced increase in the rate of formation of grains having non-parallel twinned crystal plane nuclei as well as the tabular grain nuclei.

It is thought that this is because of stabilization factors at the lamination defect surface due to the increase in the lattice constant as well as the supersaturation factor. Hence, the rate of formation of grains having non-parallel multiple twinned crystal planes is very high when the conventional method is used and a high iodide content layer with an iodide content of 7 mol% or more is introduced into the central portion of the tabular grains. In the past it was impossible to overcome this problem, but the inventors have discovered a method by which the problem can be overcome.

Thus, the effects of the supersaturation factors described under (1) to (12) above are additive, and the increase in the proportion of grains having non-parallel multiple twinned crystal planes which are formed with the formation of iodide ion is due to the increased probability of lamination defect formation, and proportion of the grains having non-parallel multiple twinned crystal planes can be reduced by shifting one or more of the factors described under (1) to (12) in the direction which reduces the frequency of twinned crystal plane formation.

Since the frequency of twinned crystal plane formation increases as the iodide ion content is increased, the extent of the shifts referred to above will depend on the iodide ion content.

Figure 6:
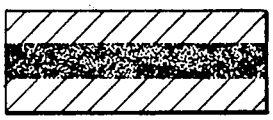

In practical terms, the increase in the number of tabular grains formed for an increase in the iodide content is determined from FIG. 6 in JP-A-63-92942 and the action to be taken may be found by determining the appropriate shifts for this increase from the graphs shown in FIGS. 2 to 11 of JP-A-63-92942.

In this invention, the preferred nuclei formation conditions for silver bromoiodide nuclei which have a high iodide content are as follows:

(i) A high gelatin concentration in the reaction solution.

(ii) Good agitation (iii) A slow rate of addition of the silver salt and the halide.

(iv) A high temperature during nuclei formation such that it is possible to obtain mono-disperse grains.

(v) The addition of a silver halide solvent.

(vi) The addition of gelatin to the aqueous solutions of silver salt and halides which are added.

(vii) A low bromide ion concentration in the reaction solution.

(viii) A high concentration of unrelated salt in the reaction solution.

(ix) The use of a low molecular weight gelatin.

In this invention, there is essentially no iodide in the reactor prior to the addition of the silver salt and the halide, and the reason for this is discussed below.

If iodide is added to the reactor beforehand, it is thought that silver iodide will be precipitated first on adding the aqueous solutions of silver salt and halide, since the solubility of silver iodide in the range from 20° C. to 80° C. is from about $1/1000^{th}$ to $1/9000^{th}$ of that of silver bromide, and that silver bromoiodide will be formed subsequently. This is undesirable since it is similar to the method described by C.R. Berry and S.J. Marino in *Journal of Phys. Chem.*, 62, 881 (1958) or the method of grain formation disclosed in U.S. Pat. No. 4,150,994 in which silver iodide is used as seed crystals, and deformed tabular grains as described earlier which have three or more twinned crystal planes per grain are formed.

However, if the amount of iodide added to the reactor beforehand is less than 3 mol% with respect to the amount of silver added during the first minute it has been found that the extent of its adverse effect is small.

The other conditions during nuclei formation in this invention are described below.

(a) A gelatin concentration of from 0.1 to 20 wt%, preferably of from 0.3 to 6 wt%, is effective. The gelatin may be of the type normally used for photographic purposes, but the use of a low molecular weight gelatin of molecular weight from 1,000 to 100,000 is preferred.

The use of a low molecular weight gelatin preferably of molecular weight from 3,000 to 60,000, is especially desirable for increasing the proportion of tabular grains of this invention.

Reference can be made to the disclosures made in Japanese Patent Application Nos. 63-315741 and 63-217274 in this connection. Furthermore, high concentration (1.6–20 wt%) gelatin solutions set at a temperature below 35° C. and thus they are difficult to use. On the other hand, low molecular weight gelatins (molecular weight 1,000–100,000) and modified gelatins such as phthalated gelatins set only with difficulty at a temperature below 35° C. and so the use of these gelatins is especially desirable.

(b) The use of an in liquid addition and mixing system such as that described in U.S. Pat. No. 3,785,777 (1974) or West German Patent Application (OLS) No. 2,556,888 is preferred for achieving adequate agitation.

(c) A rate of addition for the silver salt and halide of from $6 \times 10^{-4}$ mol/minute to $2.9 \times 10^{-1}$ mol/minute per liter of aqueous gelatin solution is preferred.

(d) The gelatins normally used for photographic purposes can be used for the gelatin which is added to aqueous silver salt or halide solution which is being added, and it can be added at a concentration within the range where it does not result in setting of these aqueous solutions. Thus it is normally used at a rate of from 0.05 to 1.6 wt%. However, if heating apparatus is provided for the solutions, the gelatin can be added at higher concentrations (about 20 wt%).

Furthermore, the use of a low molecular weight gelatin (molecular weight 1,000–100,000) or a modified gelatin, for example, is especially desirable.

When gelatin is added to the aqueous solution of silver salt or halide which is being added, if the type and concentration of the gelatin and the temperature are the same as the type and concentration of gelatin and the temperature in the reactor then these supersaturation factors are maintained uniformly in the vicinity of the addition ports and nuclei formation proceeds evenly, and this is desirable.

(e) The bromide ion concentration used in the reaction solution is such as to provide a pBr value of from 1.0 to 2.5, preferably from 1.4 to 2.4.

(f) An unrelated salt concentration in the reaction solution in the range from $1.0 \times 10^{-2}$ to 1 mol/liter can be used.

(g) The pH of the reaction solution can be set in the normal range of from 2 to 10, but the use of a pH in the normal range of from 8.0 to 9.5 is preferred for the introduction of reduction sensitized silver nuclei, while a pH in the range of form 2.0 to 8.0 is preferred when such nuclei are not being introduced.

(h) A temperature for the reaction solution within the range of from 15° to 60° C. is used.

(i) The silver halide solvent which is added to the reaction solution is normally used at a concentration in the range of from 0 to $1.5 \times 10^{-1}$ mol/liter, and the compounds described hereinafter can be used as the silver halide solvent.

All of the aforementioned supersaturation factors (1) to (12), or the overall supersaturation factor including all of these supersaturation factors, are preferably held constant during the period of nuclei formation in this invention.

The upper limit for the degree of supersaturation is given by the expression $A/B > 0.6$, and the upper limit and the lower limit for the supersaturation during nuclei formation for regaining $A/B < 0.6$ if the degree of supersaturation is too low are those which given $A/B > 0.6$, and more desirably by $A/B > 0.7$.

In general, nuclei are finely divided due to the formation of iodide ion during nuclei formation.

2. Ripening

Fine tabular grain nuclei are formed by nuclei formation as described in 1 above, but many fine grains other than these (especially octahedral and single twinned crystal grains for example) are formed at the same time. The grains other than the tabular grain nuclei must be eliminated to provide nuclei which are of a shape as close as possible to tabular grains and which provide a good mono-dispersion before entering the growth process described hereinafter, Ostwald ripening is carried out after nuclei formation in order to achieve this end.

The preferred conditions for this first Ostwald ripening are a pBr of from 1.4 to 2.4 and a temperature of from 40° to 85° C.

The silver halide solvents described hereinafter are preferably used to ensure that this ripening is carried out efficiently.

The concentration of silver halide solvent normally used in this case is from 0 to $1.5 \times 10^{-1}$ M/liter.

The gelatin concentration is preferably from 1 to 10 wt%, and the gelatin used is normally a gelatin of average molecular weight from 80,000 to 300,000 as used in the photographic industry, and the use of one of average molecular weight 100,000 preferred.

This gelatin is added during the period after nuclei formation and before the commencement of ripening.

In another more preferred method of ripening, the first ripening operation is carried out at a pBr value in the range of from 1.4 to 2.3 at first, and after increasing the proportion of tabular grains in this way a silver salt is added to adjust the pBr value in the range from 2.1 to 5.0 and then a second Ostwald ripening stage is carried out.

Besides the two stage ripening, a continuous ripening in which a pBr value is continuously changed from a low level to a high level or a tree or more stage ripening may be applied for this invention. However, the basic idea of the ripening is as follows.

That is, in the first ripening at a low pBr value, an Ostwald ripening is occurred between twinned grains having trough and grains not having trough, and the tabular grains are preferentially grown in the transverse direction. Thus, the octahedral grains are preferentially eliminated and the singly twinned crystal grains are eliminated subsequently. Thus, the grain size difference between the tabular grain and the non-tabular grain is made large.

In the subsequent second ripening at a high pBr value, an Ostwald ripening is occurred between the basal plane of tabular grains and the sphere-like surface of residual non-tabular grains. As a result, most of grains (almost 100%) would be tabular grains.

Further, the second ripening has the effect of eliminating the residual non-tabular grains in the first ripening and the effect of evening the thickness of tabular grain seed crystals.

If the ripening was conducted in the high pBr region (the region forming tetradecahedral crystals or cubic crystals, i.e., pBr 2.3 pAg 2), the grains are grown to the direction of thickness of tabular grain, and therefore, the obtained grains become thick. In order to narrow the grain size distribution, it is desired to even the grain thickness (preferably 0.09 μm or more), since if the thickness is not uniform, the rate of growth to the transverse direction during the crystal growth is not uniform.

Furthermore, if the pBr value is more high, the grain shape is close to a circular tabular shape.

In order to accelerate the second ripening, a silver halide solvent mentioned hereinafter may be used. In this case, the concentration of silver halide solvent is normally set at 0–0.3 M/l. With respect to the details of methods for removing the silver halide solvent after the completion of ripening, reference can be made to the disclosures in Japanese Patent Application No. 63-315741.

Furthermore, grains of this invention pass through the processes of nuclei formation→Ostwald ripening→ crystal growth, but crystal growth may be carried out with ripening and the elimination of non-tabular grains (untwinned crystal grains or single twinned crystal grains) during the crystal growth of the tabular grains.

This is especially effective when growing silver bromide on silver bromoiodide tabular grain nuclei.

The silver halide emulsion obtained at the end of this ripening process is an emulsion in which at least 60% of the total projected area of the silver halide grains is accounted for by tabular silver halide grains which have two parallel twinned crystal planes, and normally the tabular grains consist of hexagonal shaped tabular grains, or hexagonal tabular grains of which the corners of the hexagonal shape are slightly rounded, or circular tabular grains.

The emulsion may be washed with water at the end of this ripening process and used as a mono-disperse hexagonal tabular grain or mono-disperse circular tabular grain emulsion of this invention.

Normally, the emulsion is introduced into a crystal growing process after Ostwald ripening, and the crystals are grown to the prescribed size.

3. Growth

Grain growth is carried out following the ripening process essentially by adding an aqueous silver nitrate solution and an aqueous halide solution using the double jet method at a temperature of from 40° C. to 85° C. with a bromide ion concentration during the crystal growing period such that the pBr value is from 1.5 to 4.0, and the rate of addition of these aqueous solutions is preferably such as to provide a crystal growth rate of from 20 to 100%, and preferably of from 30 to 100%, of the crystal limiting growth rate.

In this case, the rates of addition of the silver ion and the halide ion are increased together with crystal growth, and this can be achieved, as disclosed in JP-B-48-36890 and JP-B-52-16364, by increasing the rates of addition (flow rates) of the aqueous solutions of silver salt and halide which are of fixed concentration, or by increasing the concentrations of the aqueous silver salt and halide solutions. (The term "JP-B" as used herein means of an "examined Japanese patent publication".) Furthermore, ultra-fine grain emulsions (comprising AgBr, AgI, AgCl or the mixed gains thereof) of grain size less than 0.10 μm can be prepared beforehand and the rate of addition of the ultra-fine grain emulsion can be increased. These methods may be used in combination. The rates of addition of the silver ion and halide ions can be increased intermittently or they may be increased continuously.

Furthermore, the method used to supply the iodide ion in this case may involve separate addition from a separate addition port with a triple jet as well as addition by inclusion in the aqueous halide solution with double jet addition. The methods in which a fine grain silver iodide (grain size less than 0.1 μm, and preferably less than 0.06 μm) emulsion prepared beforehand are added can also be used, and these methods may be used conjointly with the supply of an aqueous alkali halide. In this case, the fine grain silver iodide is dissolved to supply the iodide ion and so the iodide ion is supplied uniformly, and this is especially desirable.

A better mono-dispersion is achieved on growing tabular grains by increasing the pBr value and by increasing the degree of supersaturation in the growing environment during the crystal growth stage. However, growth in the thickness direction occurs on the high pBr value side (at pBr 2–4 or in the tetradecahedral or cubic crystal growth regions described hereinafter) and so mono-disperse tabular grains of low aspect ratio are obtained.

Tabular grains of high aspect ratio can be obtained if the growth takes place under the low pBr side (pBr 1.5–2.0, or in the {111} plane crystal growth region described hereinafter), but in this case the mono-dispersivity is poor.

In general, the grain size distribution of the grains obtained widens as the pBr value shifts to the low side and as the degree of supersaturation in the growing environment is reduced.

The mono-dispersivity and the aspect ratio of the tabular grains are as described above. The crystal habit of the edge parts of the tabular grains is described below. When the pBr during crystal growth is in the low pBr range mentioned above, the tabular grains obtained are such that the basal planes and most of the edge planes are {111} planes. On the other hand, when crystals are grown in the high pBr region mentioned earlier, growth occurs with increasing grain thickness, and the basal plane is a {111} plane but the edge parts are {100} planes. In this case, when growth takes place at a higher pBr value there is more growth in the thickness direction and the proportion of the {100} plane increases. Reference can be made to the description of reference example 1 of Japanese Patent Application No. 62-251377 in this connection.

Furthermore, if the pBr value during crystal growth is set in the cubic crystal growth region and the degree of supersaturation is low, the corner parts of the hexagons become rounded to provide slightly rounded hexagonal tabular grains or circular tabular grains.

Reference can be made to the disclosures of Japanese Patent Application No. 62-203635 in this connection.

On the other hand, pAg region for the formation of tetradecahedral or cubic crystals shift to the high pBr value side with the increase of iodide content. Reference can be made to the disclosures of K. Murofushi et al., *I.C.P.S.*, Tokyo (1967).

No particular limitation is imposed on the silver halide composition which is deposited on the nuclei during the growth period. In many cases the silver halide deposited is silver bromide, silver bromoiodide or silver bromochloroiodide (with an iodide content of from zero to the solid solution limit).

Cases where the iodide distribution within the grains is of the gradually increasing or gradually decreasing type growth can be realized, for example, by gradually increasing or decreasing the proportion of iodide in the halide which is added during growth. Cases in which the change occurs suddenly can be achieved by suddenly increasing or decreasing the proportion of iodide in the halide which is being added during crystal growth.

The inclusion of reduction sensitized nuclei within the silver halide grains is desirable in this invention, and from this point of view the pH of the solution during the growth period is preferably from 7.0 to 9.5.

The silver halide solvents described hereinafter can be used to accelerate growth during the crystal growth period. In such cases, the silver halide solvent concentration is preferably from zero to $1.5 \times 10^{-1}$ mol/liter.

4. Second Ostwald Ripening

The main aims of the second Ostwald ripening are as follows: (1) To remove the fine grains in cases where grain growth has been carried out with ripening as mentioned earlier, and where fine grains remain due to inadequate ripening, and in cases where new nuclei have been formed during crystal growth, and (2) to convert hexagonal tabular grains to circular tabular grains.

Reference can be mad to the disclosures, and FIG. 7, of Japanese Patent Application No. 62-203635 in this connection.

The preferred ripening conditions are given below.

Temperatures of from 40° C. to 85° C., and preferably of from 50° C. to 80° C., times of from 10 to 100 minutes, gelatin concentrations of from 1.0 to 10 wt%, silver halide solvent concentrations of from 0 to 0.15 mol/liter with the silver halide solvents as described hereinafter can be used. The pBr value is from 2 to 4.0.

Tabular grains of this invention can be formed in this way.

The silver halide grains of this invention can be used as they are in an emulsion or they may be used in combination with the conventional known techniques. For instance, silver halide layers of different halogen compositions can be deposited in the perpendicular direction with respect to the basal plane of the tabular grains using the tabular grains of this invention as a substrate, so that the halogen composition is gradually or continuously changed. Reference can be made to JP-A-63-106746 in this connection.

Furthermore, silver halide emulsions which have at least {100} and {111} crystal surfaces on the surface of a single silver halide grain and in which the halogen compositions of the surface layer of the crystal surfaces are different can be prepared using the tabular grains. Reference can be made to the disclosures made in Japanese Patent Application No. 62-251377 in this connection.

Furthermore, silver halides of a different halogen composition from that of the tabular grains can be grown additionally in the transverse direction of the tabular grains using the tabular grains as core grains.

Furthermore, silver halides of a composition different from that of the host grain can be grown selectively on just the corners of the circular tabular grains using the circular tabular grains as host grains. Reference can be mad to the disclosures made in Japanese Patent Application No. 62-319740 in this connection.

Furthermore, epitaxial grains can be formed and used using the tabular grains as host grains. Reference can be made to the disclosures made in J.E. Maskasky, *J. Imaqinq Sci.*, 32, 160 (1988), JP-A-58-108526, JP-A-59-113540, JP-A-62-32443, JP-A-55-124139, JP-A-62-7040, JP-A-59-162540 and EP 0019917 in this connection.

Furthermore, ruffled grains can be formed and used using the tabular grains as substrate grains. Reference can be made to U.S. Pat. No. 4,643,966 in this connection.

Furthermore, grains which have internal dislocations can be formed using the tabular grains as cores. Reference can be made to the disclosures of Japanese Patent Application No. 62-54640 in this connection.

Tabular grains of this invention can be formed in this way, and chemically sensitized nuclei are normally formed subsequently on the tabular grains. The number and location of the chemically sensitized nuclei are preferably controlled. Reference can be made to the disclosures made earlier in the Detailed Description of the Invention.

The tabular grains of this invention can be used as core grains for the formation of shallow internal latent image type emulsions. Reference can be made to JP-A-59-133542 and U.S. Pat. Nos. 3,206,313 and 3,317,322 in this connection.

The tabular grains of this invention can be used as core grains for the formation of emulsion grains as described in British Patent 1,458,764.

The tabular grains may be used as cores for the formation of core/shell type direct reversal emulsions. Reference can be made to illustrative example 13 of JP-A-63-151618, and U.S. Pat. Nos. 3,761,276, 4,269,927 and 3,367,778 in this connection.

Furthermore, the core/shell type direct reversal emulsions are preferably used as the structural emulsions as described in the illustrative examples of JP-A-60-95533.

Furthermore, methods in which oxidizing agents such as hydrogen peroxide or peroxy acids are added up to the completion of gold sensitization ripening and in which reducing substances are added subsequently, and methods in which the free gold ion in the light-sensitive material is minimized after gold sensitization ripening can be used. Reference can be made to JP-A-61-3134, JP-A-61-3136, JP-A-62-54249, JP-A-61-219948, JP-A-61-219949, JP-A-63-40137 and JP-A-63-40139 in this connection. The tabular grains may be spectrally sensitized with antenna dyes. Reference can be made to the disclosures in JP-A-62-209532, JP-A-63-138341 and JP-A-63-138342 in this connection.

Reference can be made to JP-A-63-151618 and the amendments thereto in connection with the details of the matters referred to above and other matters concerning the utilization of the optical interference properties of the tabular grains.

The tabular grains can be used in very hard film systems. Reference can be made to JP-A-58-113926 and Research Disclosure, Vol. 184, (August, 1979), item No. 18431, paragraph K, in this connection.

Silver halide solvents can be used to control the supersaturation conditions which determine the frequency of twinned crystal plane formation in the nuclei forming process of this invention.

Furthermore, silver halide solvents can be used to accelerate ripening in the ripening process and to accelerate crystal growth in the post ripening crystal growth period in this invention.

Thiocyanates, ammonia, thioethers and thioureas, for example, are frequently used as silver halide solvents.

For example, use can be made of thiocyanates (for example, U.S. Pat. Nos. 2,222,264, 2,448,534 and 3,320,069), ammonia and thioether compounds (for example, U.S. Pat. Nos. 3,271,157, 3,574,628, 3,704,130, 4,297,439 and 4,276,347), thione compounds (for example, JP-A-53-144319, JP-A-53-82408 and JP-A-55-77737), and amine compounds (for example, JP-A-54-100717).

Reference can be made to the disclosures of Japanese Patent Application No. 62-221288 in connection with the low molecular weight gelatins which can be used in this invention.

The silver halide emulsions of this invention can be established on a support, together with other emulsions, protective layers, intermediate layers and filter layers, as required, as a single layer or as multiple layers (for example two or three layers). Furthermore, the establishment of the layers is not limited to one side of the support and they can be established on both sides of the support. Furthermore, they can be laminated as emulsions which have different color sensitivities.

In the case of mono-disperse tabular grains of this invention it is possible to reduce the thickness of each layer when they are coated as three layers comprising large sized grain, intermediate sized grain and small sized grain emulsions, and especially where three or more layers are coated using emulsions in which the grain size has been made finer, since the tabular grains have a high aspect ratio, and it is possible to obtain higher speeds and higher picture quality without loss of sharpness since the products can be made without greatly increasing the thickness of the emulsion layer.

Hence, the mono-disperse tabular grain emulsions of this invention are particularly effective when constructions consisting cf two or more layers, and preferably from three to five layers, in which the grain size increases sequentially from the upper layer emulsions are used, and such constructions are preferred.

Reference can be made to the disclosures of JP-A-63-151618 in connection with the layer structure.

Various metal dopants can be added during the formation and physical ripening of the silver halide grains.

The sensitizing dyes, anti-fogging agents and stabilizers used in the invention can be present in any of the manufacturing processes of the photographic emulsions, and they can be included at any stage after manufacture until immediately before coating.

No particular limitation is imposed on the additives which can be used during the preparation of the silver halide emulsions of this invention, or on the photographic film structure or processing.

Reference can be made to *Research Disclosure,* volume 176, 1978, December issue (item 17643), *Research Disclosure,* volume 184, (August, 1979) (item 18431), *Product Licensing Index,* volume 92, 107–110 (December, 1971), JP-A-58-113926 to 113928, JP-A-61-3134, JP-A-62-6251, JP-A-62-115035, Japanese Chemical Society, Monthly Reports 1984, December issue, pages 18–27, Japanese Patent Application Nos. 62-219982 and 62-203635, T.H. James, *The Theory of the Photographic Process,* fourth edition, Macmillan, New York, 1977, and V.L. Zelikman et al., *Making and Coating Photographic Emulsion,* (published by the Focal Press, 1964) in connection with the chemical sensitizers, spectrally sensitizing dyes, anti-fogging agents, metal ion dopants, intermediate chalcogen compounds, silver halide solvents, stabilizers, dyes, color couplers, DIR couplers, binders, film hardening agents, coating aids, viscosity imparting agents, emulsion precipitants, plasticizers, dimensional stability improving agents, anti-static agents, fluorescent whiteners, lubricants, delustering agents, surfactants, ultraviolet absorbers, dispersion and absorbing materials, hardening agents, anti-stick agents, agents for improving photographic characteristics (for example, development accelerators and contrast enhancers), couplers which release photographically useful fragments with developers (for example, development inhibitors or accelerators, bleach accelerators, developing agents, silver halide solvents, toners, film hardening agents, anti-fogging agents, competitive couplers, chemical or spectral sensitizers and desensitizers), dye image stabilizers, self-inhibiting developing agents which can be added and the methods whereby these additives can be used, in connection with supersensitization, the effect of the halogen acceptors and electron acceptors of spectrally sensitizing dyes, the action of anti-fogging agents, stabilizers, development accelerators and inhibitors, in connection with the apparatus used for the preparation of emulsions of this invention, reactors, agitators, coating, methods of drying, methods of exposure (light sources, exposing environment, method of exposure), photographic supports, fine porous supports, subbing layers, surface protective layers, matting agents, intermediate layers, anti-halation layers, silver halide emulsion structural layers, and in connection with photographic processing agents and processing methods.

Silver halide emulsions of this invention can be used in black and white silver halide photographic materials (for example, X-ray light-sensitive materials, lith type light-sensitive materials and black and white camera materials), and color photographic materials (for example, color negative films, color reversal films, color papers and silver dye-bleach type photographic materials). Moreover, they can also be used, for example, in diffusion transfer photosensitive materials (for example, color diffusion transfer elements and silver salt diffusion transfer elements), and in heat developable type photosensitive materials (color, and black-and-white).

Furthermore, emulsions of this invention are preferably used as the structural emulsions in example 9 of Japanese Patent Application No. 62-203635, examples 13 and 14 of JP-A-60-95533 and JP-A-63-151618 and example 1 of JP-A-62-269958, and as the structural emulsions for the examples in Japanese Patent Application Nos. 62-141112 and JP-A-62-266538 and JP-A-63-220238.

The silver halide emulsions of this invention have the characteristics of tabular grains described in 1) to 8) in the Background of the Invention and the characteristics of iodides as described in (1) to (11) in the Background of the Invention and they provide high speed, excellent graininess, sharpness and resolution, and high picture quality with a high covering power.

In particular, silver halide photographic emulsions of this invention consisting of double structure grains of which the iodide content of the central portion is from 7 mol% to the solid solution limit and of which the iodide content of the outermost shell layer is from 0 to 6 mol% provide the effects disclosed in section V of JP-A-63-92942.

Furthermore, silver halide photographic emulsions of this invention in which the iodide content of the central portion is from 7 mol% to the solid solution limit and in which the iodide content of the outermost layer of the shell is from 6 mol% to the solid solution limit, and preferably from 6 to 30 mol% have (a) good blue light absorption efficiency and a high blue speed because of the iodide content of both the central portion and the shell, (b) good sensitizing dye adsorbing properties because of the high surface iodide content so that larger amounts of sensitizing dyes can be adsorbed, and they have good light absorption efficiency and a high color sensitized speed, (c) properties such that the implanation of photoholes from the sensitizing dye is facilitated because of the high energy level of the upper edge of the valency electron band of the outermost shell layer, and the implanted photoholes react with the reduction sensitized silver nuclei within the grain and release an electron, thereby increasing the speed, and (d) a reduced initial development rate and good graininess properties.

ILLUSTRATIVE EXAMPLES

Actual examples of the invention, comparative examples and reference examples are described below to describe the invention in more detail, but the embodiments of the invention are in no way limited by these examples. Unless otherwise specified all percents, ratios, parts, etc. are by weight.

REFERENCE EXAMPLE 1

One liter of aqueous gelatin solution was introduced into a reaction having a capacity of 4 liters, the pH was adjusted to 6 using nitric acid and potassium hydroxide, potassium bromide was added and then, while maintaining at a constant temperature and stirring the solution, an aqueous solution of silver nitrate (containing 32.6 grams of silver nitrate per liter) and an aqueous halide solution (aqueous potassium bromide, potassium iodide solution) were added simultaneously over a period of 4 minutes using precision fixed flow rate pumps. The pBr value was held constant during this addition. Subsequently, after stirring for 2 minutes the agitation was stopped and one third of the emulsion was taken for use as a seed crystal emulsion. Thus, an aqueous gelatin solution (1,000 ml of water, 25 grams of deionized alkali treated gelatin, pH 6.0, potassium bromide) was added, the pBr value was set to 1.8, the temperature was raised to 60° C. and, after ripening for 18 minutes, 500 ml of an aqueous silver nitrate solution (containing 25 grams of silver nitrate) and an aqueous solution of potassium bromide were added over a period of 25 minutes at a rate of 8 ml/minute while maintaining the pBr value at 1.8. After leaving the mixture to stand for a further period of 5 minutes, the addition was continued at a rate of 12 ml/minute for a period of 25 minutes. The pBr value was then set to 2.1 by continuing the addition of just the aqueous silver nitrate solution.

The emulsion so obtained was divided into three parts and heated to 75° C., ammonia (25 wt% aqueous solution) was added in an appropriate amount selected in the range of from 0 to 7 ml/liter and the emulsions were sampled during the ripening process. TEM images of the silver halide grains obtained by sampling in this way were examined. The corresponding circle diameter of the projected area, and the thickness, of the tabular grains were obtained from the TEM images of the samples from which the non-parallel tabular fine grains had been essentially eliminated and which consisted essentially of just tabular grains, and the average volume was calculated. The number of tabular grains formed was then obtained from this value and the amount of silver which had been added.

In the formation of the grains described above, only the conditions during the nuclei forming period (the stage prior to raising the temperature to 60° C.) were varied and the grains were subjected to Ostwald ripening and grain growth under the same conditions subsequently (under conditions such that no new tabular grains were formed and none were eliminated). That is to say, at the end of the first ripening process there were still a large number of fine grains remaining, and these were grown under conditions in which the tabular grains were grown selectively and to easily provide a discriminable difference in size between the fine grains and the tabular grains, after which the fine grains were eliminated by the second Ostwald ripening process.

The nuclei forming conditions were modified in various ways in this method and the relationship between the nuclei formation conditions and the number of tabular grains produced was investigated, and correlation diagrams like those shown in FIGS. 2 to 11 of JP-A-63-92942 were obtained.

It was clear from the results obtained that the probability of lamination defects occurring depends on the concentration of gelatin in the reaction solution, the rate of agitation, the addition time, the temperature, the amount of silver halide solvent, the bromide ion concentration, the unrelated salt concentration, the pH, the molecular weight of the gelatin and the iodide content of the aqueous halides salt which is being added.

EXAMPLE 1

An aqueous gelatin solution (1,000 ml of water, 12.5 grams of deionized alkali treated gelatin, 2 grams of potassium bromide, adjusted to pH 9.0 with 6.2 ml of 1N potassium hydroxide solution, pBr 1.77) was introduced into a reactor having a capacity of 4 liters and, while maintaining the temperature at 30° C., 100 ml of an aqueous solution of silver nitrate (containing 32.6 grams of silver nitrate) and 100 ml of an aqueous halide solution (containing 18.6 grams of potassium bromide and 6.37 grams of potassium iodide) were added simultaneously over a period of 4 minutes (rate of addition 25 ml/minute) and then, after stirring for 2 minutes, a precipitant and a 1N nitric acid solution were added and the emulsion was precipitated at pH 4.0 and washed with water. Uniform silver bromoiodide (20 mol% iodide) seed crystals were obtained.

The recovery was 700 ml in this case, and 350 ml was taken as seed crystals. Thus, an aqueous gelatin solution (1,000 ml of water, 2 grams of potassium bromide, 25 grams of deionized alkali treated gelatin) was added and the pH was adjusted to 9.0, and then the temperature was raised to 65° C. After ripening for 18 minutes at 65° C. (pBr 1.9), 250 ml of an aqueous silver nitrate solution (containing 26 grams of silver nitrate) and 250 ml of an aqueous potassium bromide solution (containing 18.94 grams potassium bromide) were added simultaneously over a period of 25 minutes. The mixture was then stirred for 5 minutes, after which the pBr value was adjusted to 2.3 using a silver nitrate solution of the same concentration, 2.0 ml of an ammonia (25 wt%) solution and 3.0 ml of an ammonium nitrate (50 wt%) solution were added, the temperature was raised to 75° C. and, after ripening for 60 minutes, the temperature was reduced to 30° C. and the emulsion was washed with water and dispersed.

In this case, the gelatin concentration during nuclei formation was 1.25 wt%, the rate of addition of the silver salt was $4.8 \times 10^{-2}$ mol/minute, the rate of addition of the halide was $4.87 \times 10^{31}$ 2 mol/minute and the pBr value was 1.77.

A TEM image of a replica of the emulsion grains obtained was observed and the characteristic values were as follows.

Proportion of the surface area occupied by hexagonal tabular grains of this invention: 98.0%
Average grain size (in diameter): 0.52 μm
Mean aspect ratio: 9.5
Average thickness: 0.055 μm
Coefficient of variation: 30%

On the other hand, on measuring the X-ray diffraction patterns of emulsion grains obtained by sampling after nuclei formation and after ripening, the X-ray diffraction profiles based on the (220) plane indicated a uniform composition of about 20 mol% silver bromoiodide.

The iodide content of the core of these grains was 20 mol% and the average iodide content of the grains overall was 7.8 mol% and the calculated mole fraction of the central portion was 0.39.

COMPARATIVE EXAMPLE 1

Grains were formed in the same way as in Example 1 except that the amount of potassium bromide in the reactor during nuclei formation was set at 4 grams, the temperature was set at 25° C. and the amount of aqueous halide solution was set at 100 ml (containing 19.0 grams of potassium bromide and 6.7 grams of potassium iodide).

In this case, the gelatin concentration during nuclei formation was 1.25 wt%, the rate of addition of the silver salt was $4.8 \times 10^{-2}$ mol/minute, the rate of addition of the halide was $4.95 \times 10^{-2}$ mol/minute and the pBr value was 1.47.

The characteristic values of the emulsion obtained are indicated below.

Average grain size (in diameter): 0.36 μm
Average thickness: 0.3 μm
Mean aspect ratio: 1.2
Proportion of projected area accounted for by hexagonal tabular grains of this invention: 28%
Coefficient of variation: 41%
Mole fraction of silver iodide in central portion: 0.39
Silver iodide content of the central portion: 20 mol%

In this case, the temperature, and the bromide ion concentration during nuclei formation were such as to raise the degree of supersaturation and, since the degree of supersaturation was not adjusted by means of the other factors, it became too high overall and there was a marked increase in the proportion of grains having non-parallel, twinned crystal planes.

EXAMPLE 2

An aqueous gelatin solution (1,000 ml of water, 20 grams of deionized alkali treated gelatin, 3 grams of potassium bromide, adjusted to pH 9.0 with 10 ml of 1N potassium hydroxide solution, pBr 1.6) was introduced into a reactor of capacity 4 liters and, while maintaining the mixture at a temperature of 30° C., 100 ml of an aqueous solution of silver nitrate (containing 32.6 grams of silver nitrate) and 100 ml of an aqueous halide solution (containing 18.6 grams of potassium bromide and 6.37 grams of potassium iodide) were added simultaneously over a period of 4 minutes (rate of addition 25 ml/minute) and then, after stirring for 2 minutes, a precipitant and a 1N nitric acid solution were added and the emulsion was precipitated at pH 4.0 and washed with water.

The recovery was 700 ml in this case, and 350 ml was taken as seed crystals. Thus, an aqueous gelatin solution (1,000 ml of water, 2 grams of potassium bromide, 25 grams of deionized alkali treated gelatin) was added and the pH was adjusted to 9.0, and then the temperature was raised to 65° C. After ripening for 18 minutes at 65° C. (pBr 1.9), 250 ml of an aqueous solution of silver nitrate (containing 26 grams of silver nitrate) and 250 ml of an aqueous potassium bromide solution (containing 18.9 grams potassium bromide) were added simultaneously over a period of 25 minutes. The mixture was then stirred for 5 minutes, after which the pBr value was adjusted to 2.3 using a silver nitrate solution of the same concentration, 2.0 ml of an ammonia (25 wt%) solution and 3.0 ml of an ammonium nitrate (50 wt%) solution were added, the temperature was raised to 75° C. and, after ripening for 60 minutes, the temperature was reduced to 30° C. and the emulsion was washed with water and dispersed.

The same characteristic values in Example 1 were as follows:

Average grain size: 0.56 μm
Average thickness: 0.055 μm
Mean aspect ratio: 10.2
Proportion of the surface area occupied by hexagonal tabular grains of this invention (Projected area): 98.0%
Coefficient of variation: 32%

The iodide content of the central portion of these grains was 20 mol%. In this case, the supersaturation during nuclei formation was raised relative to that in Example 1 by the bromide ion concentration, but the supersaturation overall was adjusted by increasing the gelatin concentration.

EXAMPLE 3

An aqueous gelatin solution (1,000 ml of water, 20 grams of deionized alkali treated gelatin, 2 grams of potassium bromide, adjusted to pH 9.0 with 10 ml of 1N potassium hydroxide solution, pBr 1.77) was introduced into a reactor of capacity 4 liters and, while maintaining the mixture at a temperature of 30° C., 100 ml of an aqueous solution of silver nitrate (containing 32.6 grams of silver nitrate) and 100 ml of an aqueous halide solution (containing 16.4 grams of potassium bromide and 9.55 grams of potassium iodide) were added simultaneously over a period of 4 minutes (rate of addition 25 ml/minute) and then, after stirring for 2 minutes, a precipitant and a 1N nitric acid solution were added and the emulsion was precipitated at pH 4.0 and washed with water.

The recovery was 400 ml in this case, and 200 ml was taken as seed crystals. Thus, an aqueous gelatin solution (1,150 ml of water, 2 grams of potassium bromide, 25 grams of deionized alkali treated gelatin) was added and the pH was adjusted to 9.0, and then the temperature was raised to 65° C. After ripening for 18 minutes at 65° C. (silver potential −18 mV), 250 ml of an aqueous solution of silver nitrate (containing 26 grams of silver nitrate) and 250 ml of an aqueous potassium bromide solution (containing 18.94 grams potassium bromide) were added simultaneously over a period of 25 minutes. The mixture was then stirred for 5 minutes, after which the pBr value was adjusted to 2.3 using a silver nitrate solution of the same concentration, 2.0 ml of an ammonia (25 wt%) solution and 3.0 ml of ammonium nitrate (50 wt%) solution were added, the temperature was raised to 75° C. and, after ripening for 60 minutes, the temperature was reduced to 30° C. and the emulsion was washed with water and dispersed.

The same characteristic values as in Example 1 are shown below.

Average grain size: 0.57 μm
Average thickness: 0.056 μm
Mean aspect ratio: 10.2
Proportion of the projected area occupied by hexagonal tabular grains of this invention: 96.5%
Coefficient of variation: 32%

The iodide content of the central portion of these grains was 30 mol%. Furthermore, the mol fraction of the central portion was 0.39. In this case, the supersaturation during nuclei formation was raised relative to that in Example 1 by the iodide ion content, but the degree of supersaturation overall was adjusted by increasing the gelatin concentration.

EXAMPLE 4

In comparison to Example 1, the same conditions were used as far as the ripening conditions after nuclei formation, and then the conditions during growth were such that 250 ml of an aqueous silver nitrate solution (containing 26 grams of silver nitrate) and 250 ml of an aqueous halide solution (containing 14.5 grams of potassium bromide and 4.8 grams of potassium iodide) were added simultaneously over a period of 30 minutes. After completing the addition, the pBr value was adjusted to 2.3 using a silver nitrate solution of the same concentration, 9 ml of an ammonium nitrate (50 wt%) solution and 5 ml of aqueous ammonia (25 wt%) were added, and the temperature was raised to 75° C. After ripening for 50 minutes, the temperature was reduced to 30° C., the emulsion was washed with water and dispersed, and the recovery was 700 ml.

The same characteristic values as in Example 1 are shown below.

Average grain size: 0.56 μm
Average thickness: 0.08 μm
Mean aspect ratio: 7.0
Proportion of the projected area occupied by Tabular grains of this invention: 97%
Coefficient of variation: 34%

On the other hand, the X-ray diffraction of the emulsified grains was measured and the X-ray diffraction profile based on the (220) plane showed a diffraction peak based on the core layer of silver bromoiodide with a uniform composition of about 20 mol%.

An aqueous solution of gelatin (6 grams of sodium chloride, 15 grams of gelatin, 300 ml of water) was added to 700 ml of this emulsion, the pH was adjusted to 6.0, 70 ml of aqueous silver nitrate solution (containing 10 grams of silver nitrate) and 70 ml of aqueous halide solution (containing 5.6 grams of potassium bromide and 1.5 grams of sodium chloride) were added over a period of 10 minutes at 60° C. and a shell layer of composition $AgBr_{80}Cl_{20}$ was obtained.

Mol fraction of the central portion: 0.81
Silver iodide content of the central portion: 20 mol%
Thickness of the shell: 0.01 μm
Silver iodide content of the shell: 0%

EXAMPLE 5

An aqueous gelatin solution (1,000 ml of water, 20 grams of deionized alkali treated gelatin, 1.4 grams of potassium bromide, adjusted to pH 9.0 with 10 ml of 1N potassium hydroxide solution, pBr 1.93) was introduced into a reactor of capacity 4 liters and, while maintaining the mixture at a temperature of 30° C., 100 ml of an aqueous solution of silver nitrate (containing 32.6 grams of silver nitrate) and 100 ml of an aqueous halide solution (containing 18.6 grams of potassium bromide and 6.37 grams of potassium iodide) were added simultaneously over a period of 4 minutes (tate of addition 25 ml/minute) and then, after stirring for 2 minutes, a precipitant and a 1N nitric acid solution were added and the emulsion was precipitated at pH 4.0 and washed with water. The recovery was 700 ml in this case, and 350 ml was taken as seed crystals. Thus, an aqueous gelatin solution (1,000 ml of water, 0.6 grams of potassium bromide, 25 grams of deionized alkali treated gelatin) was added, 2.0 ml of an ammonia (25 wt%) solution and 3.0 ml of an ammonium nitrate (50 wt%) solution were added, the temperature was raised to 75° C. and the emulsion was ripened for 60 minutes. The characteristic values obtained from a TEM photograph of the emulsion grains at this time were as shown below.

Average grain size: 1.1 μm
Average thickness: 0.1 μm
Mean aspect ratio: 11.0
Proportion of the projected area occupied by hexagonal tabular grains of this invention: 95%
Coefficient of variation: 40%

Next, the temperature was adjusted to 55° C. and the pH was adjusted to 8.8 with a 1N nitric acid solution, after which 125 ml of an aqueous silver nitrate solution (containing 13 grams of silver nitrate) and 125 ml of an aqueous potassium bromide solution (containing 12 grams of potassium bromide) were added using a controlled double jet method over a period of 25 minutes at −15 mV. After the addition had been completed, the emulsion was stirred for 5 minutes, after which the temperature was reduced to 30° C. and the emulsion was washed with water and dispersed.

On measuring the X-ray diffraction of the emulsion grains the (220) plane diffraction profile indicated the presence of a silver bromoiodide core layer of about 20 mol% and a silver bromide shell layer.

Mole fraction of the central portion: 0.556
Silver iodide content of the central portion: 20 mol%
Thickness of the shell: 0.022 μm
Silver iodide content of the shell: 0%

The emulsions obtained in Examples 1 to 5 were sulfur sensitized and gold sensitized in the usual way, anti-fogging agent TAI (4-hydroxy-6-methyl-1,3,3a,7-tetraazaindene) and coating aid (sodium alkylarylsulfonate) were added and the emulsions were coated (coated silver weight 1.5 g/m$^2$ on a triacetylcellulose film support). In all cases, good photographic properties reflecting the characteristics of the tabular grains and the effect of the iodide ion were obtained.

EXAMPLE 6

An aqueous gelatin solution (1 liter of water, average molecular weight ($\overline{M}$) 20,000, 8 grams of gelatin, 2 grams of KBr, pH 6.5) was introduced into a reactor and, while maintaining the temperature at 30° C., 27.5 ml of an aqueous solution of silver nitrate (containing 32 grams of silver nitrate, 0.8 gram of gelatin ($\overline{M}$: 20,000) and 0.2 mol% of 1N $HNO_3$ in 100 ml) and 27.5 ml of an aqueous halide solution (containing 20.1 grams of KBr, 3.77 grams of KI and 0.8 gram of gelatin having $\overline{M}$ 20,000) were added simultaneously by a direct in-liquid addition method (rate of addition 25 ml/minute) and then, after stirring for 1 minute, an aqueous gelatin solution (380 ml of water, 32 grams of deionized alkali treated gelatin having $\overline{M}$ of 100,000, pH 6.5) was added. An average size of the formed nuclei at that point was 0.02 μm in diameter. After keeping for 2 minutes, the temperature was raised to 75° C. over 10 minutes). The average iodide content at that point was about 12 mol%.

After ripening for 16 minutes, an aqueous silver nitrate solution (10 wt%) was added in a constant rate over 3 minutes to adjust the pBr value to 2.4. Next, 7 mol of an aqueous ammonia solution (25 wt%) was added and the thus obtained emulsion was ripened for 20 minutes.

A TEM image of an emulsion grain obtained by sampling was observed and the characteristic value were as follows.

Proportion of projected area occupied by hexagonal tabular grains of this invention: 99%
Average grain size (in diameter): 0.45 μm
Average grain thickness: 0.07 μm
Mean aspect ratio: 6.4
Coefficient of variation: 18%

Average iodide content of seed emulsion grains was 9.7 mol%.

Next, after neutralizing the ammonia with 3N of an aqueous $HNO_3$ solution to pH 6.5, an aqueous silver nitrate solution (12 wt%) and an aqueous halide solution (containing 7.76 grams of KBr and 1.17 grams of KI in 100 ml of water) were added by a linear flow rate addition for 50 minutes at silver potential +70 mV (initial flow rate: 5 ml/minute, terminal flow rate: 17.5 ml). After stirring for 3 minutes, then the temperature was reduced to 30° C. and washed with water, and the obtained emulsion grains were re-dispersed at 40° C. A TEM image of the thus obtained grains was observed. The characteristic values were as follows:

Proportion of projected area occupied by hexagonal tabular grains of this invention: 99%
Average grain size (in diameter): 0.89 μm
Average grain thickness: 0.13 μm
Mean aspect ratio: 6.8
Coefficient of variation: 18%

Average iodide content of the shell portion was 10 mol%.

The emulsion was heated to 55° C. and hypo and gold-thiocyanate complex were added thereto. After ripening for 50 minutes, the temperature was adjusted to 40° C. A TAI ($8 \times 10^{-3}$ mol/mol-AgX) and a coating aid were then added and the emulsion was coated on a TAC base at a coated silver amount of 1.5 g/m$^2$. The coated emulsion was exposed for 0.01 second through a wedge by a tungsten light through a filter of color temperature of 5,500° K. and developed for 15 minutes at 20° C. in MAA-1 developer described in T.H. James et al., *Photogr. Sci. Tech.*, 19B:170 (1953). The coated emulsion displayed excellent characteristic with respect to speed and graininess.

EXAMPLE 7

The procedure of Example 6 was repeated up to the step of the first ripening for 10 minutes at 75° C.

Next, an aqueous silver nitrate solution (10 wt%) was added in a constant rate for 3 minutes to adjust the pBr value to 3.0 and 12 ml of an aqueous ammonia solution (25 wt%) was added thereto and then ripened for 20 minutes. A TEM image of the sampled emulsion grains at that point was observed. The characteristic values were as follows:

Proportion of projected area occupied by circular tabular grains of this invention: 99%
Average grain size (in diameter): 0.36 μm
Average grain thickness: 0.13 μm
Mean aspect ratio: 3.0
Coefficient of variation: 22%

Next, after neutralizing the ammonia with 3N of an aqueous $HNO_3$ solution to pH 6.5, the grains were grown in the same condition of Example 6 except that the silver potential was 10mV. The observation results of a TEM image of the obtained emulsion grains were as follows:

Proportion of projected area occupied by hexagonal tabular grains of this invention: 99%
Average grain size (in diameter): 0.936 μm
Average grain thickness: 0.14 μm
Mean aspect ratio: 6.7
Coefficient of variation: 18%

While the invention has been described in detail and with reference to specific examples thereof, it will be apparent to one skilled in the art that various changes and modifications can be made therein without departing from the spirit and scope thereof.

What is claimed is:

1. A silver halide photographic emulsion comprising silver halide grains, wherein at least 60% of the total projected area of said silver halide grains is comprised of tabular silver halide grains having a central portion and an outer portion, of which the iodide content of the central portion is from 7 mol% to the solid solution limit, and which have two parallel twinned crystal planes.

2. A silver halide photographic emulsion as in claim 1, wherein the shape of the basal plane of said tabular silver halide grains is hexagonal with an adjacent side ratio (longest side length/shortest side length) of not more than 2, the linear part ratio of said hexagon is at least 4/5, and the aspect ratio is at least 2.

3. A silver halide photographic emulsion as in claim 1, wherein the shape of the basal plane of said tabular silver halide grains is circular with a linear part ratio of the basal plane of not more than 4/5, and the aspect ratio is at least 2.

4. A silver halide photographic emulsion as in claim 1, wherein said tabular silver halide grains are tabular AgBrI or AgBrICl grains of multi-layer structure comprising a core and at least one shell layer, the iodide content of the outermost shell layer being from 0 to 6 mol%.

5. A silver halide photographic emulsion as in claim 1, wherein said tabular silver halide grains are tabular AgBrI or AgBrICl grains of multi-layer structure comprising a core and at least one shell layer, the iodide content of the outermost shell layer being from 6 mol% to the solid solution limit.

* * * * *